US008193894B2

(12) United States Patent
Miyoshi et al.

(10) Patent No.: US 8,193,894 B2
(45) Date of Patent: Jun. 5, 2012

(54) ELECTRONIC COMPONENT AND METHOD OF MANUFACTURING SAME

(75) Inventors: Hiromi Miyoshi, Shiga-ken (JP); Masaki Inui, Shiga-ken (JP); Hiromichi Tokuda, Fukui-ken (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 12/752,875

(22) Filed: Apr. 1, 2010

(65) Prior Publication Data

US 2010/0253464 A1 Oct. 7, 2010

(30) Foreign Application Priority Data

Apr. 2, 2009 (JP) ..... 2009-089646

(51) Int. Cl.
*H01F 5/00* (2006.01)
*H01F 27/28* (2006.01)
*H01F 7/06* (2006.01)

(52) U.S. Cl. ..... 336/200; 336/222; 336/223; 336/232; 29/602.1

(58) Field of Classification Search ..... None
See application file for complete search history.

(56) References Cited

U.S. PATENT DOCUMENTS 5,251,108 A * 10/1993 Doshita ..... 361/792
5,392,019 A * 2/1995 Ohkubo ..... 336/200
6,124,779 A * 9/2000 Yamamoto ..... 336/200
6,541,968 B1 * 4/2003 Tokuda ..... 324/258
7,327,207 B2 * 2/2008 Asakawa ..... 333/175
7,362,098 B2 * 4/2008 Ando et al. ..... 324/258
7,694,414 B2 * 4/2010 Maeda et al. ..... 29/832
2007/0296536 A1 * 12/2007 Odahara et al. ..... 336/200
2008/0048816 A1 * 2/2008 Matsumoto et al. ..... 336/200
2010/0141370 A1 * 6/2010 Lu et al. ..... 336/200

FOREIGN PATENT DOCUMENTS

CN 101145426 A 3/2008
JP H04-206910 A 7/1992
JP H04-130409 U 11/1992
JP 6-069057 3/1994

(Continued)

OTHER PUBLICATIONS

The Office Action issued on May 22, 2011 from the Korean Intellectual Property Office; Korean Patent Application No. 2010-0023201with abstract.

Japanese Office Action "Notification of Reasons for Rejection" issued Jul. 5, 2011; Japanese Patent Application No. 2009-089646 with translation.

(Continued)

*Primary Examiner* — Lincoln Donovan
*Assistant Examiner* — Mangtin Lian
(74) *Attorney, Agent, or Firm* — Studebaker & Brackett PC; Tim L. Brackett, Jr.; John F. Guay

(57) ABSTRACT

An electronic component capable of obtaining a large inductance value and a high Q value and a method of manufacturing the electronic component are provided. A coil includes a plurality of coil conductors incorporated in a multilayer structure, a plurality of lands provided at the plurality of coil conductors, and a via-hole conductor connecting the plurality of lands. Lead-out conductors are incorporated in the multilayer structure and connect the coil and external electrodes. The plurality of coil conductors form a substantially rectangular loop path in plan view from the z-axis direction by overlapping each other. The plurality of lands protrude toward outside the path at a short side of the path and do not overlap the lead-out conductors in plan view from the z-axis direction.

6 Claims, 9 Drawing Sheets

FOREIGN PATENT DOCUMENTS

| | | | |
|---|---|---|---|
| JP | 9-190922 | | 7/1997 |
| JP | 2000-150241 | A | 5/2000 |
| JP | 2002-151331 | A | 5/2002 |
| JP | 2002-334806 | A | 11/2002 |
| JP | 2005-191191 | A | 7/2005 |
| JP | 2005-294637 | A | 10/2005 |
| JP | 2007-194387 | A | 8/2007 |
| KR | 10-2007-0096037 | A | 10/2007 |

OTHER PUBLICATIONS

The second Office Action from the Korean Intellectual Property Office issued on Jan. 19, 2012 with abstract.

The First Office Action issued by the Chinese Patent Office dated Feb. 23, 2012; Chinese Patent Application No. 201010156411.1.

* cited by examiner

ELECTRONIC COMPONENT AND METHOD OF MANUFACTURING SAME

CROSS REFERENCE TO RELATED APPLICATIONS

This application claims priority to Japanese Patent Application No. JP 2009-089646, filed Apr. 2, 2009, the entire contents of which are incorporated herein by reference in their entirety.

BACKGROUND

1. Field of the Invention

The invention relates to an electronic component and a method of manufacturing the same and, in particular, an electronic component incorporating a coil and a method of manufacturing the same.

2. Description of the Related Art

One known traditional electronic component is a multilayer chip inductor described in Japanese Unexamined Patent Application Publication No. 2005-191191. The multilayer chip inductor described in this patent document is explained below with reference to the drawings. FIGS. 9A and 9B illustrate multilayer chip inductors 500 and 600, as seen through from the direction of layering.

As illustrated in FIG. 9A, the multilayer chip inductor 500 includes a multilayer structure 502. The multilayer structure 502 incorporates a coil L, as illustrated in FIG. 9A. The coil L is configured such that a plurality of coil conductors 504 are connected together by a via-hole conductor (not illustrated). The coil L forms a substantially rectangular loop path composed of short sides L1 and L2 and long sides L3 and L4 by the plurality of coil conductors 504 overlapping each other, as illustrated in FIG. 9A.

The multilayer structure 502 further incorporates lead-out conductors 506*a* and 506*b*. The lead-out conductors 506*a* and 506*b* are extended out to side faces of the multilayer structure 502 and connected to external electrodes (not illustrated) and also connected to the coil L.

The coil L in the multilayer chip inductor 500 illustrated in FIG. 9A includes lands 508*a* and 508*b*. The lands 508*a* and 508*b* are portions in the coil L that are connected to a via-hole conductor. The via-hole conductor may preferably be thick to reliably connect the coil conductors 504, so the lands 508*a* and 508*b* are wider than the line width of each of the coil conductors 504. The lands 508*a* and 508*b* protrude toward outside the loop path at the long sides L3 and L4, as illustrated in FIG. 9A. This can prevent the area inside the coil L (that is, the area of a section surrounded by the loop path) from being reduced by protrusion of the lands 508*a* and 508*b* toward inside the loop path. In other words, the multilayer chip inductor 500 can avoid causing a reduction in the value of inductance of the coil L to some extent.

However, the multilayer chip inductor 500 illustrated in FIG. 9A still has the problem of reduction in the value of inductance of the coil L. More specifically, the lands 508*a* and 508*b* protrude toward outside the loop path at the long sides L3 and L4. Therefore, the distance W1 between a side face of the multilayer structure 502 and each of the long sides L3 and L4 is smaller by the amount of the protrusion of each of the lands 508*a* and 508*b* than that which would occur if the lands 508*a* and 508*b* did not exist. The distance W1 needs to have a sufficient length in order to prevent the coil L from being exposed from the side face of the multilayer structure 502. Therefore, as illustrated in FIG. 9A, when the lands 508*a* and 508*b* protrude from the long sides L3 and L4, respectively, it is necessary to displace each of the long sides L3 and L4 by the amount of the protrusion of each of the lands 508*a* and 508*b* toward the inner portion of the multilayer structure 502. As a result, the area inside the coil L is smaller by the amount of an area twice the product of the length of each of the long sides L3 and L4 and the protrusion of each of the lands 508*a* and 508*b* than that which would occur if the lands 508*a* and 508*b* did not exist. This results in a reduction in the value of inductance of the coil L.

For a multilayer chip inductor 600 illustrated in FIG. 9B, lands 608*a* and 608*b* protrude toward outside the loop path at the short sides L1 and L2. Also in this case, it is necessary to displace the short sides L1 and L2 toward the inner portion of a multilayer structure 602 by the amount of the protrusion of the lands 608*a* and 608*b*. Accordingly, the area inside the coil L of the electronic component 600 is smaller by an area twice the product of the length of each of the short sides L1 and L2 and the protrusion of each of the lands 608*a* and 608*b* than that which would occur if the lands 608*a* and 608*b* did not exist.

The length of each of the short sides L1 and L2 is smaller than the length of each of the long sides L3 and L4. Hence, the amount of reduction in the area inside the coil L in the multilayer chip inductor 600 illustrated in FIG. 9B is smaller than that in the multilayer chip inductor 500 illustrated in FIG. 9A. Accordingly, the reduction in the area inside the coil L in the multilayer chip inductor 600 is suppressed more than that in the multilayer chip inductor 500. In other words, the reduction in the value of inductance of the coil L in the multilayer chip inductor 600 is suppressed more than that in the multilayer chip inductor 500.

However, the multilayer chip inductor 600 illustrated in FIG. 9B has the problem of increase in stray capacitance occurring in the coil L, as described below. More specifically, as illustrated in FIG. 9B, the lands 608*a* and 608*b* overlap lead-out conductors 606*a* and 606*b*, respectively, in plan view from the direction of layering. Hence, stray capacitance occurs between the lands 608*a* and 608*b* and the conductors 606*a* and 606*b*, and thus stray capacitance of the coil L increases. As a result, the Q value of the coil L decreases.

SUMMARY

To overcome the problems described above, embodiments in accordance with the claimed invention provide an electronic component capable of obtaining a large inductance value and a high Q value and a method of manufacturing the electronic component.

According to one aspect, an electronic component includes a multilayer structure, a coil, an external electrode, and a lead-out conductor. The multilayer structure includes a plurality of insulator layers. The coil includes a plurality of coil conductors incorporated in the multilayer structure, a plurality of lands provided at the plurality of coil conductors, and a via-hole conductor connecting the plurality of lands. The external electrode is provided on a surface of the multilayer structure. The lead-out conductor is incorporated in the multilayer structure and connects the coil and the external electrode. The plurality of coil conductors form a substantially rectangular loop path by overlapping each other in plan view from a direction in which a coil axis extends. In plan view from the direction in which the coil axis extends, the plurality of lands protrude toward outside the path at a short side of the path and do not overlap the lead-out conductor.

According to another aspect, a method of manufacturing the electronic component includes forming, by a photolithography process, the insulator layers each having a via hole provided at a location where the via-hole conductor is to be provided and forming the coil conductors, the lands, and the via-hole conductor on the insulator layers.

Embodiments of the present invention can provide an electronic component having a large inductance value and a high Q value.

Other features, elements, characteristics and advantages of the present invention will become more apparent from the following detailed description with reference to the attached drawings.

DETAILED DESCRIPTION

An electronic component and a method of manufacturing the same according to exemplary embodiments are described below with reference to the drawings.

Configuration of Electronic Component

Figure 1:
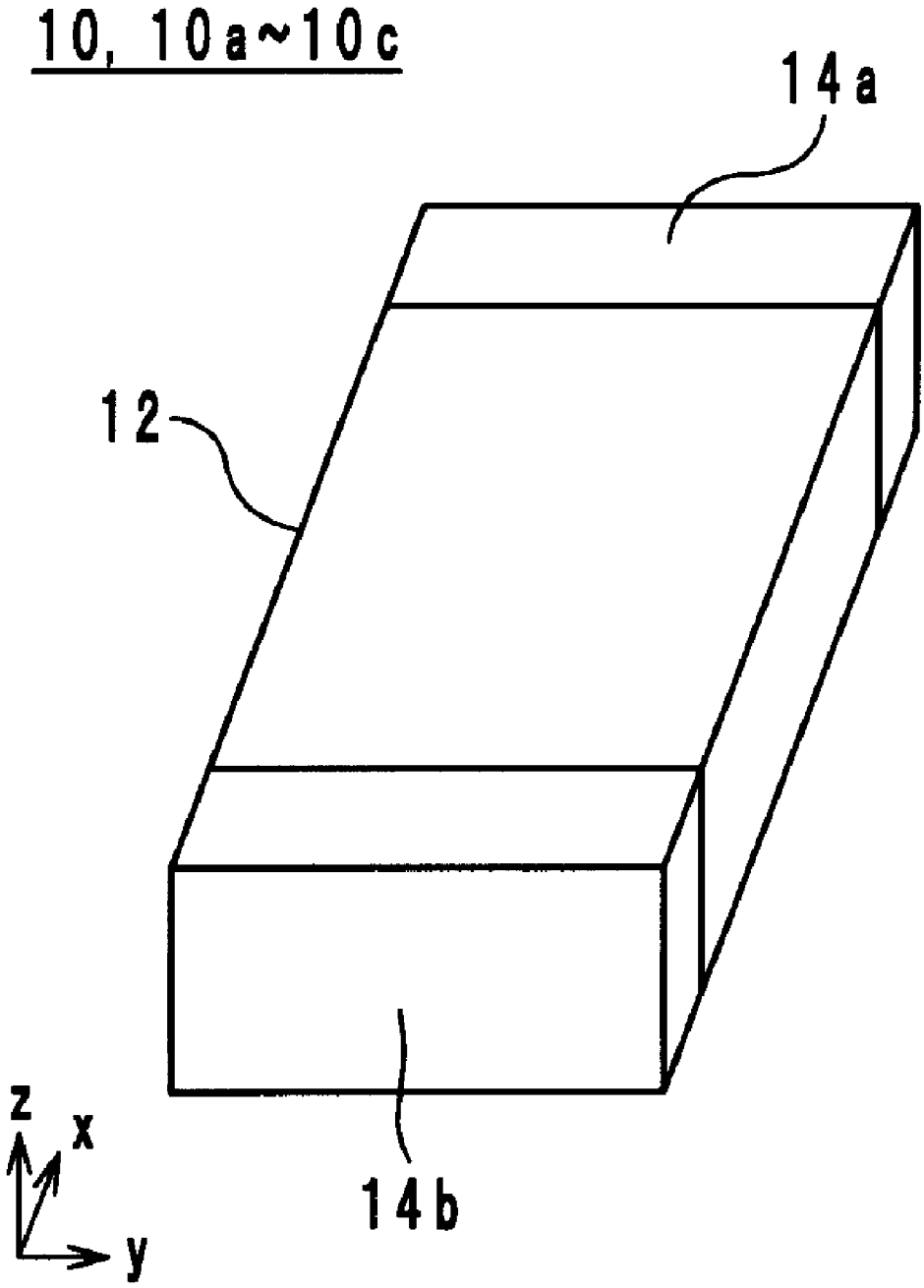
FIG. 1 is an external perspective view of electronic components according to exemplary embodiments.
Figure 2:
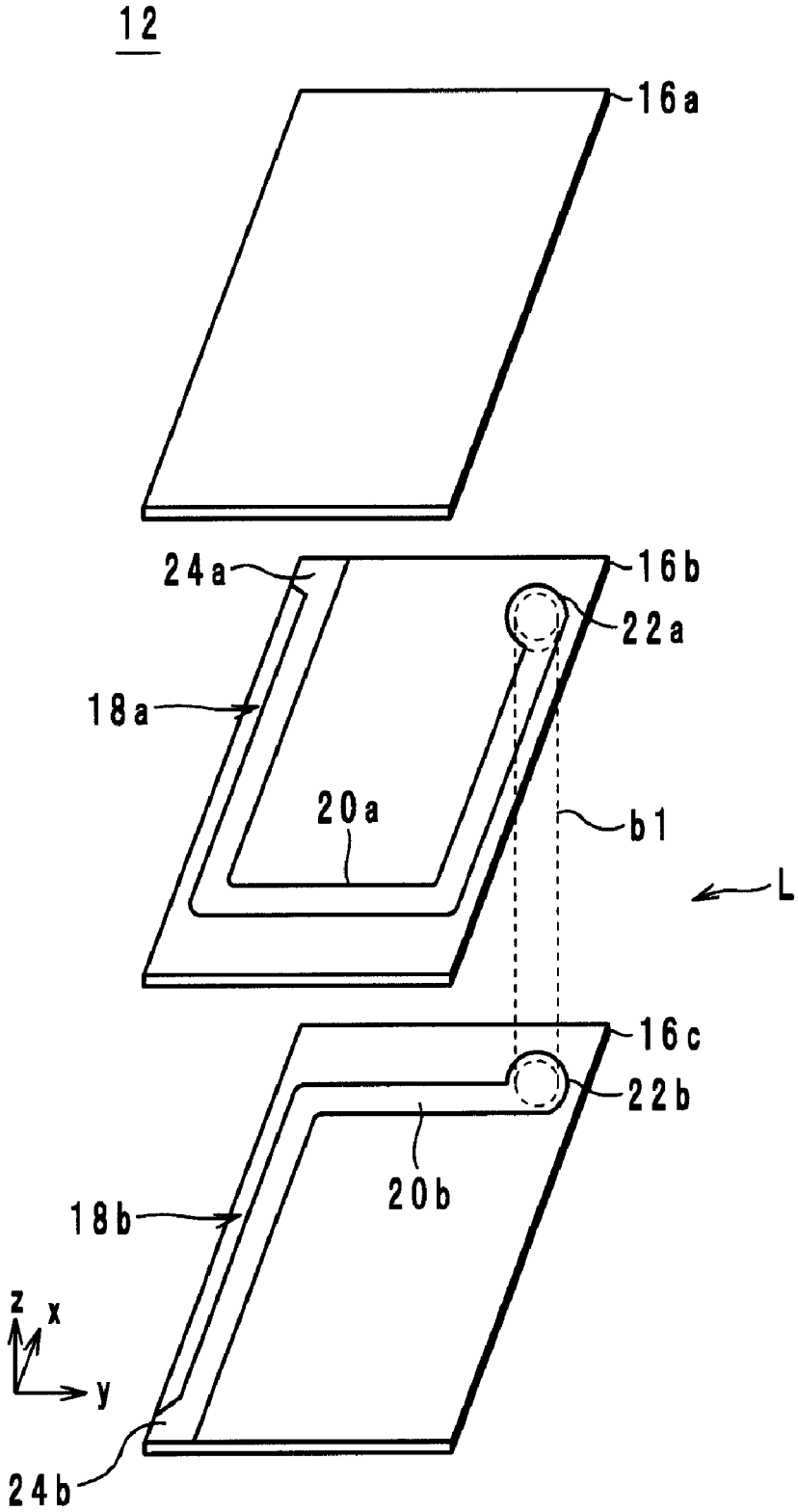
FIG. 2 is an exploded perspective view of a multilayer structure of one electronic component illustrated in FIG. 1.
Figure 3:
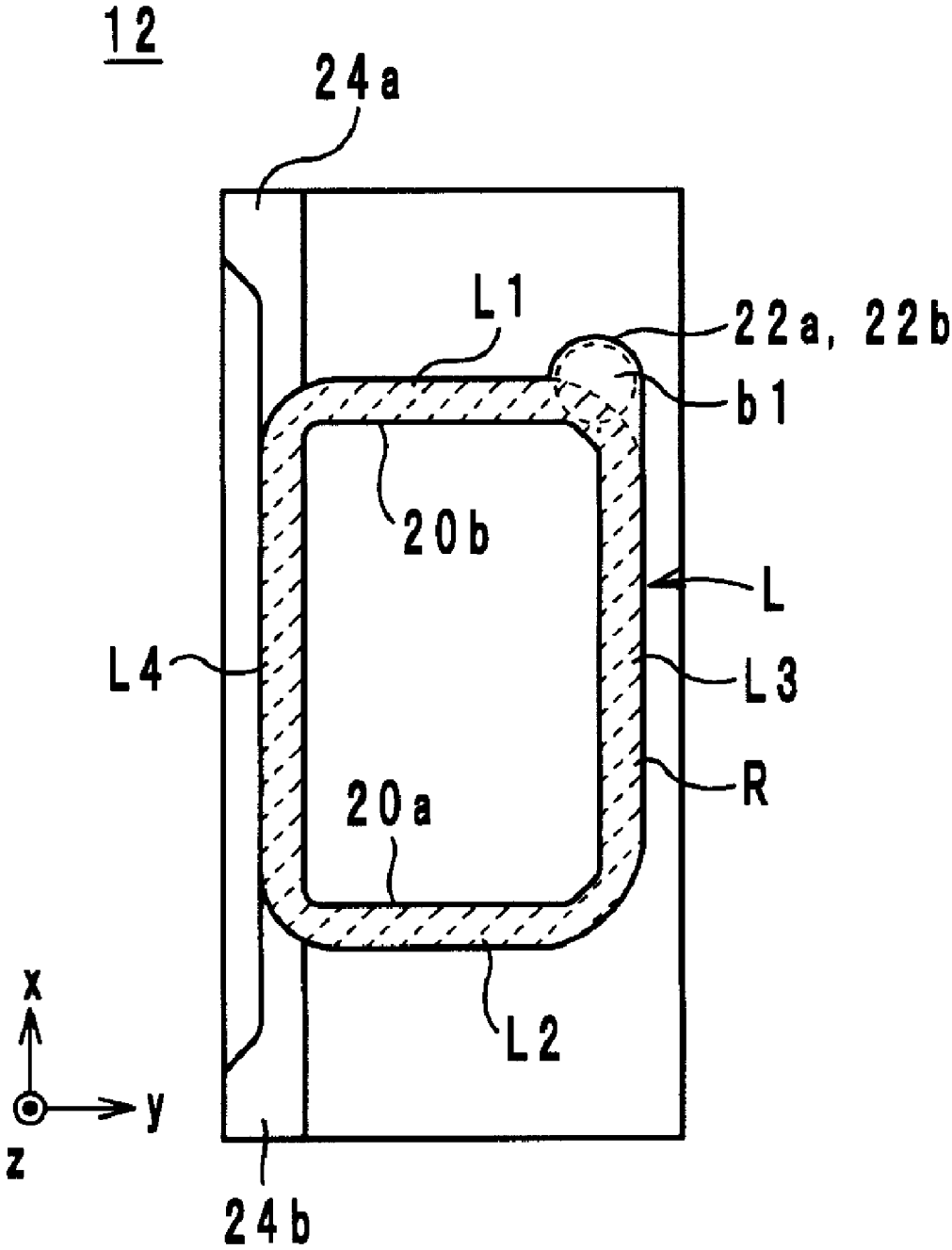
FIG. 3 is a view of the multilayer structure of one electronic component illustrated in FIG. 1, as seen through from the direction of layering.

A configuration of an electronic component according to an exemplary embodiment is described below with reference to the drawings. FIG. 1 is an external perspective view of electronic components 10 and 10*a* to 10*c* according to exemplary embodiments. FIG. 2 is an exploded perspective view of a multilayer structure 12 of the electronic component 10 illustrated in FIG. 1. FIG. 3 is a view of the multilayer structure 12 of the electronic component 10, as seen through from the direction of layering. In FIGS. 1 to 3, the direction of layering and the direction in which the coil axis extends are defined as the z-axis direction; the longitudinal direction of the electronic component 10 is defined as the y-axis direction; the lateral direction of the electronic component 10 is defined as the y-axis direction. The x-axis direction, y-axis direction, and z-axis direction are orthogonal to each other.

As illustrated in FIG. 1, the electronic component 10 includes the multilayer structure 12 and external electrodes 14 (14*a*, 14*b*). The multilayer structure 12 has a substantially rectangular parallelepiped shape, as illustrated in FIG. 1. The external electrodes 14 are provided on side faces (surfaces) of the multilayer structure 12 at both ends in the x-axis direction.

As illustrated in FIG. 2, the multilayer structure 12 includes insulator layers 16 (16*a* to 16*c*) and incorporates a spiral coil L and lead-out conductors 24 (24*a*, 24*b*). Each of the insulator layers 16 is a substantially rectangular layer made of ceramic that contains glass and aluminum oxide.

As illustrated in FIG. 2, the coil L includes internal conductors 18 (18*a*, 18*b*) and a via-hole conductor b1. The internal conductors 18*a* and 18*b* are made of a conductive material, for example, whose main ingredient is silver and provided on the insulator layers 16*b* and 16*c*, respectively. The internal conductor 18*a* includes a coil conductor 20*a* and a land 22*a*, and the internal conductor 18*b* includes a coil conductor 20*b* and a land 22*b*.

As illustrated in FIG. 2, each of the coil conductors 20 is incorporated in the multilayer structure 12 and is a substantially linear conductor that constitutes part of a substantially rectangular path. Specifically, the coil conductor 20*a* is composed of a substantially linear conductor that corresponds to two long sides and one short side of a substantially rectangular shape and is substantially U-shaped. That is, the coil conductor 20*a* has approximately three quarters of a turn. The coil conductor 20*b* is composed of a substantially linear conductor that corresponds to one long side and two short sides of the substantially rectangular shape and is substantially L-shaped. That is, the coil conductor 20*b* has approximately one half of a turn.

As illustrated in FIG. 3, the coil conductors 20*a* and 20*b* form a substantially rectangular loop path R by overlapping each other in plan view from the z-axis direction. The path R is composed of the short sides L1 and L2 and long sides L3 and L4. The short sides L1 and L2 extend along the y-axis direction. The long sides L3 and L4 extend along the x-axis direction. The short side L1 is positioned at a more positive side in the x-axis direction than the short side L2. The long side L3 is positioned at a more positive side in the y-axis direction than the long side L4.

As illustrated in FIG. 2, each of the lands 22 is provided at an end of each of the coil conductors 20 and has a width greater than the line width of the coil conductor 20. Specifically, the land 22*a* is provided at a downstream end in the counterclockwise direction of the coil conductor 20*a*. The land 22*b* is provided at an upstream end in the counterclockwise direction of the coil conductor 20*b*. The lands 22*a* and 22*b* have substantially circular shapes having diameters greater in length than the line widths of the coil conductors 20*a* and 20*b*, respectively. The lands 22*a* and 22*b* overlap each other in plan view from the z-axis direction.

As illustrated in FIG. 3, the land 22 protrudes toward outside the path R at the short side L1. The land 22 is not provided at the long sides L3 and L4. More specifically, the land 22 is provided at an end position in the positive y-axis direction of the short side L1 (that is, at a corner formed by the short side L1 and the long side L3) and protrudes in the positive x-axis direction. The electronic component 10 is thus configured such that the land 22 does not protrude toward inside the path R.

As illustrated in FIG. 2, the via-hole conductor b1 passes through the insulator layer 16*b* along the z-axis direction and connects the lands 22*a* and 22*b*. The diameter of the via-hole conductor b1 is larger than the line width of the coil conductor 20, as illustrated in FIGS. 2 and 3. The diameter of the via-hole conductor b1 is smaller than the diameter of the land 22. The above-described coil conductors 20, lands 22, and via-hole conductor b1 form the spiral coil L. The coil L has approximately 1.25 turns.

As illustrated in FIG. 2, the lead-out conductors 24*a* and 24*b* connect the coil L to respective external electrodes 14*a* and 14*b* shown in FIG. 1, and do not overlap the lands 22*a* and 22*b* in plan view from the z-axis direction. Specifically, the lead-out conductor 24*a* is extended out to a side face in the positive x-axis direction and thus connects the external electrode 14*a* and the coil L. In addition, the lead-out conductor 24*a* is provided at an upstream end in the counterclockwise direction of the coil conductor 20*a*, so the lead-out conductor 24*a* overlaps the path R at an end in the negative y-axis direction of the short side L1, as illustrated in FIG. 3. That is, the lead-out conductor 24*a* is connected to the coil L at the short side L1 with an end at which the land 22 is not provided (corner formed by the short side L1 and the long side L3) therebetween. Therefore, the land 22 and the lead-out conductor 24*a* do not overlap each other in plan view from the z-axis direction.

The lead-out conductor 24*b* is extended out to a side face in the negative x-axis direction and thus connects the external electrode 14*b* and the coil L. In addition, the lead-out conductor 24*b* is provided at a downstream end in the counterclockwise direction of the coil conductor 20*b*, so the lead-out conductor 24*b* overlaps the path R at an end in the negative y-axis direction of the short side L2, as illustrated in FIG. 3.

Method of Manufacturing Electronic Component

An exemplary method of manufacturing an electronic component 10 is described below with reference to the drawings. In the following description, a method of manufacturing an electronic component 10 for use in producing a plurality of electronic components 10 at a time is described.

First, a paste insulating material of ceramic made of glass and aluminum oxide is applied onto a film base (not illustrated in FIG. 2), and the entire surface is exposed to ultraviolet radiation to form an insulator layer 16*c*. Then, an internal conductor 18*b* and a lead-out conductor 24*b* are formed onto the insulator layer 16*c* by a photolithography process. Specifically, a paste conductive material whose main ingredient is silver is applied onto the insulator layer 16*c* and then exposed and developed to form the internal conductor 18*b*.

Then, an insulator layer 16*b* having a via hole formed at a location where a via-hole conductor b1 is to be provided is formed by a photolithography process. Specifically, a paste insulating material is applied onto the insulator layer 16*c*, internal conductor 18*b*, and the lead-out conductor 24*b*. In addition, exposure and development are carried out to form the insulator layer 16*b* having a via hole formed at a location where the via-hole conductor b1 is to be provided.

Then, an internal conductor 18*a*, a lead-out conductor 24*a*, and the via-hole conductor b1 are formed on the insulator layer 16*b* by a photolithography process. A paste conductive material is applied onto the insulator layer 16*b* and then exposed and developed to form the internal conductor 18*a*, lead-out conductor 24*a*, and via-hole conductor b1.

Then, a paste insulating material is applied onto the insulator layer 16*b*, internal conductor 18*a*, and lead-out conductor 24*a*, and the entire surface is exposed to ultraviolet radiation to form the insulator layer 16*a*. In this way, a mother multilayer structure including a plurality of multilayer structures 12 is produced.

Then, the mother multilayer structure is divided into individual multilayer structures 12 by cutting the mother multilayer structure while pressing it down. After that, each of the multilayer structures 12 is fired with a specific temperature for a specific period of time.

Then, the multilayer structure 12 is abraded by the use of a barrel, thus rounding edges and removing burrs and also exposing the lead-out conductors 24*a* and 24*b* from the multilayer structure 12.

Then, side faces of the multilayer structure 12 are dipped into silver paste and baked to form a silver electrode. Lastly, a coating of nickel, copper, zinc, or other metallic materials is deposited onto the silver electrode to form external electrodes 14*a* and 14*b*. Through the above-described steps, the electronic component 10 is completed.

Figure 9A:
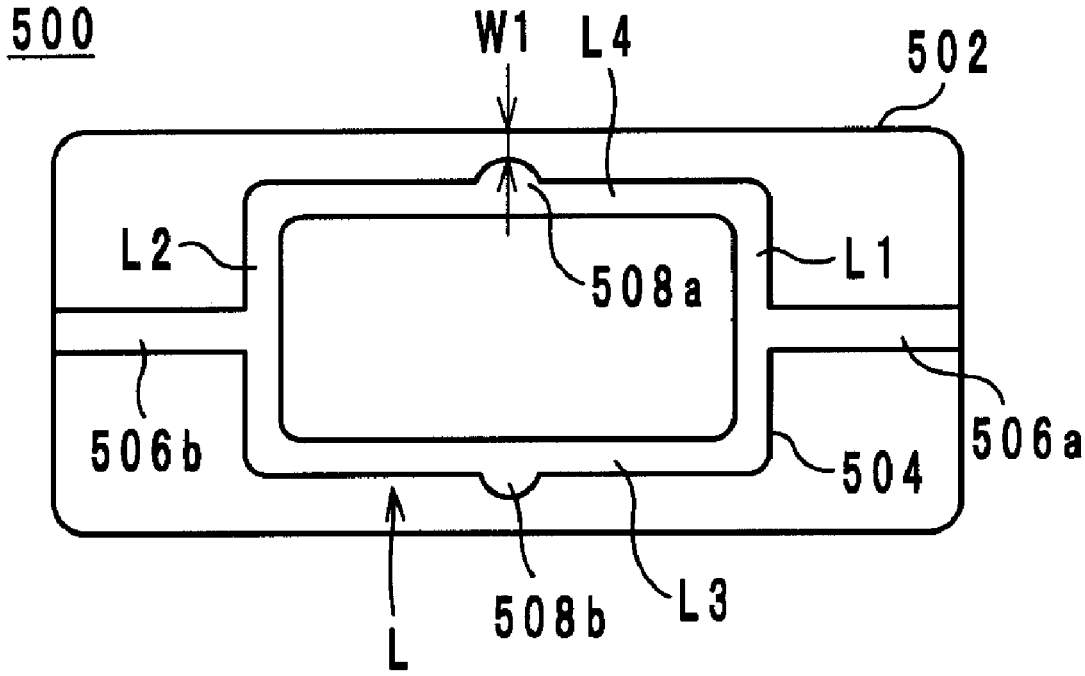
FIG. 9A Prior Art
FIGS. 9A and 9B are views of multilayer chip inductors described in Japanese Unexamined Patent Application Publication No. 2005-191191, as seen through the direction of layering.

With the above electronic component 10, a larger inductance value is obtainable as described below. More specifically, for the multilayer chip inductor 500 illustrated in FIG. 9A, the lands 508*a* and 508*b* protrude toward outside the loop path at the long sides L3 and L4. Therefore, the distance W1 between a side face of the multilayer structure 502 and each of the long sides L3 and L4 is reduced by the amount of the protrusion of each of the lands 508*a* and 508*b*. The distance W1 needs to have a sufficient length to prevent the coil L from being exposed from the side face of the multilayer structure 502. Therefore, as illustrated in FIG. 9A, when the lands 508*a* and 508*b* protrude from the long sides L3 and L4, respectively, it is necessary to displace each of the long sides L3 and L4 toward the inner portion of the multilayer structure 502 by the amount of the protrusion of each of the lands 508*a* and 508*b*. As a result, the area inside the coil L is smaller by the amount of an area twice the product of the length of each of the long sides L3 and L4 and the protrusion of each of the lands 508*a* and 508*b* than that which would occur if the lands 508*a* and 508*b* did not exist. This results in a reduction in the value of inductance of the coil L.

In contrast, for the electronic component 10, the land 22 projects toward outside the path R at the short side L1, as illustrated in FIG. 3. Also in this case, it is necessary to displace the short side L1 toward the inner portion of the multilayer structure 12 by the amount of the protrusion of the land 22. Accordingly, the area inside the coil L is smaller by an area corresponding to the product of the length of the short side L1 and the protrusion of the land 22 than that which would occur if the land 22 did not exist.

However, the length of the short side L1 is smaller than the length of each of the long sides L3 and L4. Hence, the amount of reduction in the area inside the coil L in the electronic component 10 is smaller than that in the multilayer chip inductor 500. Accordingly, the reduction in the area inside the coil L in the electronic component 10 is suppressed more than that in the multilayer chip inductor 500. In other words, the reduction in the value of inductance of the coil L in the electronic component 10 is suppressed more than that in the multilayer chip inductor 500.

Figure 9B:
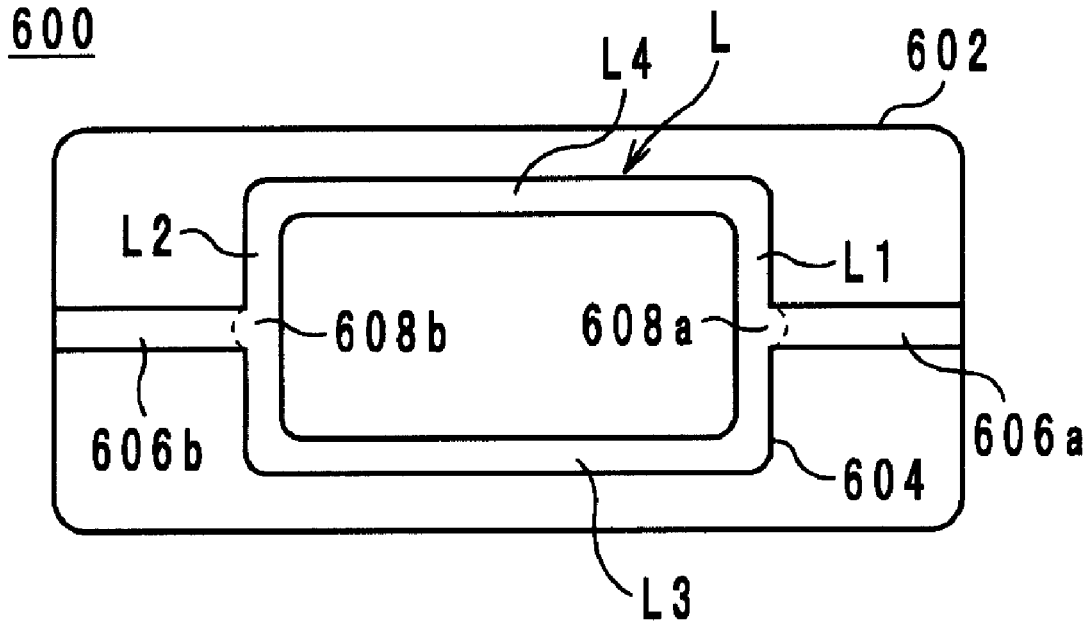
FIG. 9B Prior Art

Additionally, with the electronic component 10, a high Q-value is obtainable, as described below. More specifically, as illustrated in FIG. 9B, for the multilayer chip inductor 600, the lands 608*a* and 608*b* overlap the lead-out conductors 606*a* and 606*b*, respectively, in plan view from the direction of layering. Accordingly, stray capacitance occurs between the lands 608*a* and 608*b* and the lead-out conductors 606*a* and 606*b*, and thus stray capacitance in the coil L increases. As a result, with the multilayer chip inductor 600, the Q value of the coil L decreases.

In contrast, for the electronic component 10, the land 22 does not overlap the lead-out conductor 24, as illustrated in FIG. 3. Accordingly, stray capacitance occurring between the land 22 and the lead-out conductor 24 is smaller than that occurring between the lands 608*a* and 608*b* and the lead-out conductors 606*a* and 606*b*. As a result, with the electronic component 10, a higher Q value is obtainable compared with the multilayer chip inductor 600.

In particular, for the electronic component 10, the land 22 is provided at a first end of the short side L1, whereas the lead-out conductor 24*a* is provided at a second end of the short side L1, as illustrated in FIG. 3. Therefore, the land 22 and the lead-out conductor 24 are spaced away from each other. Hence, for the electronic component 10, the occurrence of stray capacitance between the land 22 and the lead-out conductor 24 can be more effectively suppressed. That is, with the electronic component 10, a high Q value is obtainable.

For the electronic component 10, the diameter of each of the land 22 and the via-hole conductor b1 is larger than the line width of the coil conductor 20. Hence, the land 22 and the via-hole conductor b1 are in contact with each other through a relatively large area. As a result, the occurrence of poor connection between the via-hole conductor b1 and each of the coil conductors 20*a* and 20*b* can be reduced.

With the method of manufacturing the electronic component 10 described herein, the via-hole conductor b1 having a relatively large diameter can be easily formed. More specifically, if a laser beam is used to form a via hole, it is difficult for the via hole to have a relatively large diameter. In contrast, with the method of manufacturing the electronic component 10 described herein, the insulator layer 16*b* is produced by a photolithography process. With the photolithography process, a via hole with a relatively large diameter can be easily formed. Hence, with the method of manufacturing the electronic component 10, the via-hole conductor b1 having a relatively large diameter can be easily formed.

The inventors conducted an experiment and simulation described below in order to further clarify advantageous effects provided by the electronic component 10. More specifically, samples and analysis models of three different kinds of electronic components described below were produced. Then, an experiment for examining the incidence of breaks in wiring for the samples of the electronic components was carried out. The relationship between a frequency and a Q value was also examined by the use of the analysis models for the electronic components.

Figures 4A, 4B, 4C:
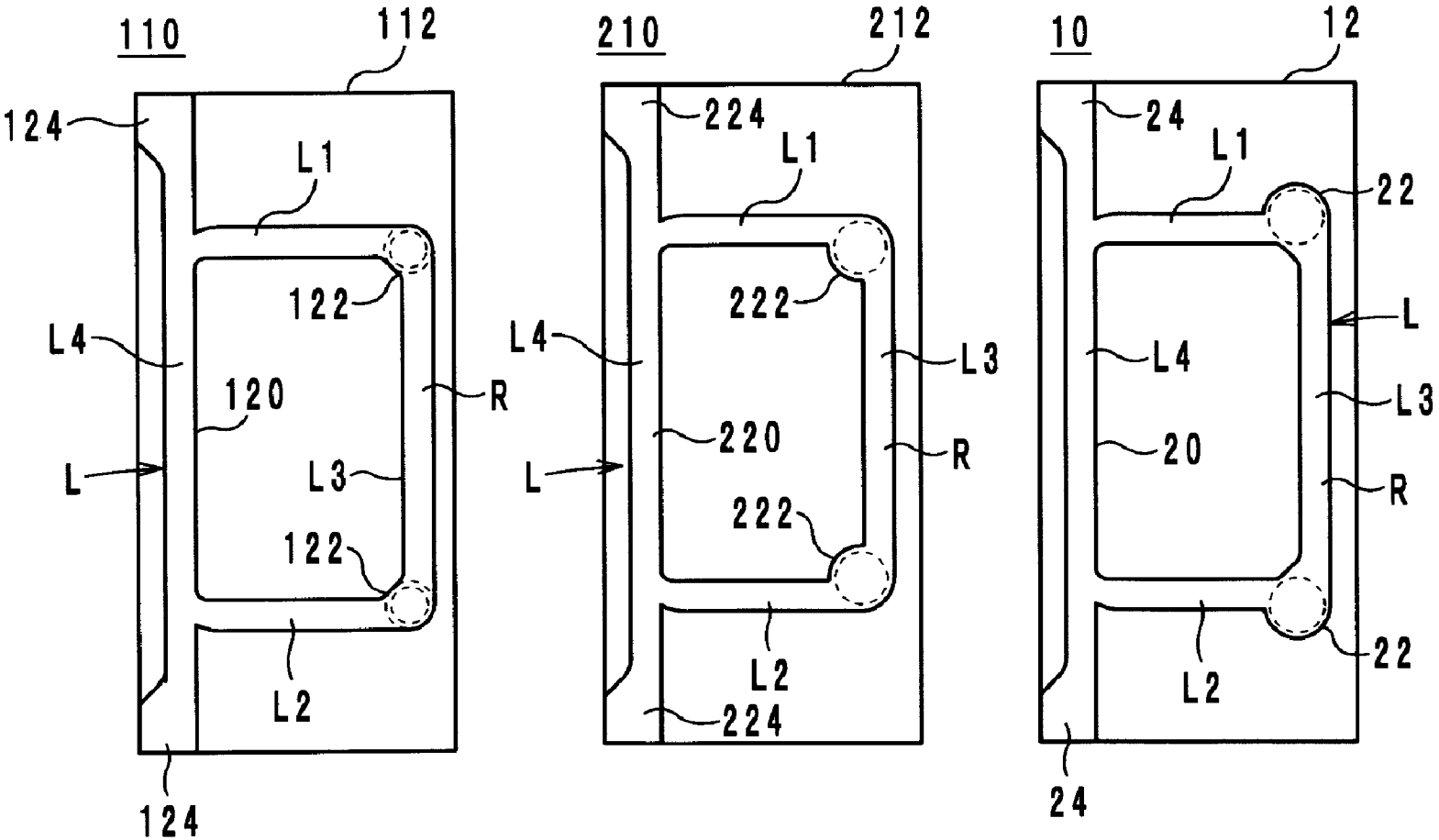
FIGS. 4A to 4C are views of three different kinds of electronic components, as seen through from the z-axis direction.

FIGS. 4A to 4C are views of the three different kinds of electronic components 10, 110, and 210, as seen through from the z-axis direction. In FIGS. 4A to 4C, external electrodes are omitted. The electronic component 10 is the electronic component 10 according to an exemplary embodiment. The number of turns of the coil L is approximately 1.25. The electronic component 110 is an electronic component according to a first comparative example. The electronic component 110 includes a land 122 having a diameter that is substantially the same as the line width of a coil conductor 120. Accordingly, the land 122 does not protrude toward inside the path R. The electronic component 210 is an electronic component according to a second comparative example. The electronic component 210 includes a land 222 having a diameter that is larger than the line width of a coil conductor 220. The land 222 protrudes toward inside the path R. The detailed configurations of the electronic components 10, 110, and 210 are provided in Table 1.

TABLE 1

| | Electronic Component 10 | Electronic Component 110 | Electronic Component 210 |
|---|---|---|---|
| Line Width of Coil Conductor | 30 μm | 30 μm | 30 μm |
| Diameter of Via-hole Conductor | 50 μm | 20 μm | 50 μm |
| Diameter of Land | 60 μm | 30 μm | 60 μm |
| Length of Each of Short Sides L1, L2 | | 230 μm | |
| Length of Each of Long Sides L3, L4 | | 530 μm | |
| Size of Electronic Component | | 0.6 mm × 0.3 mm × 0.3 mm | |

First, experimental results are described. The incidences of breaks in wiring for the electronic components 10, 110, and 210 are 0%, 25%, and 0%, respectively. These experimental results reveal that the incidences of breaks in wiring between the via-hole conductor and the coil conductor for the electronic components 10 and 210, each of which has the via-hole conductor with a relatively large diameter, are relatively low, whereas the incidence of breaks in wiring between the via-hole conductor and the coil conductor for the electronic component 110, which has the via-hole conductor with a relatively small diameter is relatively high. Accordingly, it has been found that, with the electronic component 10, the occurrence of breaks between the coil conductor 20 and the via-hole conductor b1 can be suppressed.

Figure 5:
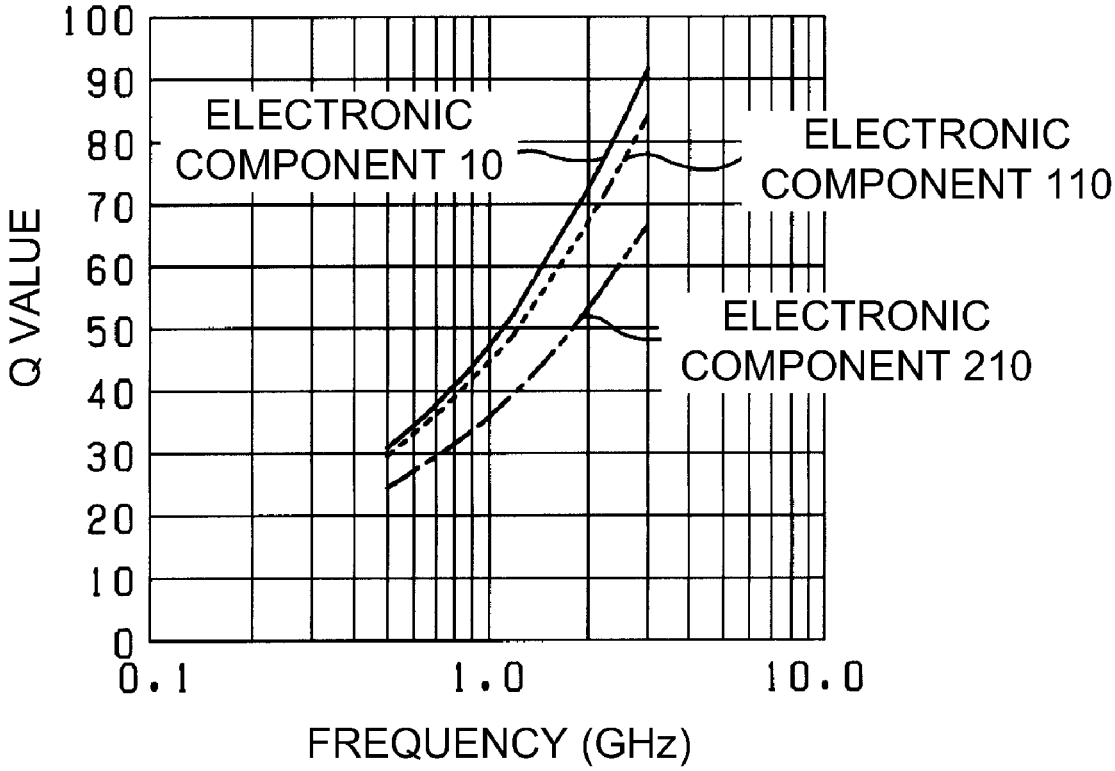
FIG. 5 is a graph that illustrates results of a simulation.

Next, simulation results are described. FIG. 5 is a graph that illustrates the simulation results. The vertical axis indicates a Q value, and the horizontal axis indicates a frequency. FIG. 5 reveals that the Q value of the electronic component 10 is the largest and the Q value of the electronic component 210 is the smallest. Possible reasons of this are discussed below.

The land 122 of the electronic component 110 is smaller than the land 222 of the electronic component 210. Therefore, the area inside the coil L of the electronic component 110 is larger than that of the electronic component 210. As a result, the value of inductance of the coil L of the electronic component 110 is larger than that of the electronic component 210. Accordingly, the Q value of the electronic component 110 is larger than that of the electronic component 210. The diameter of the via-hole conductor of the electronic component 10 is larger than that of the via-hole conductor of the electronic component 110. Therefore, the value of direct-current resistance of the coil L of the electronic component 10 is smaller than that of the electronic component 110. Accordingly, the Q value of the electronic component 10 is larger than that of the electronic component 110. For the above reasons, with the electronic component 10, a high Q value is obtainable.

Modifications

Figure 6:
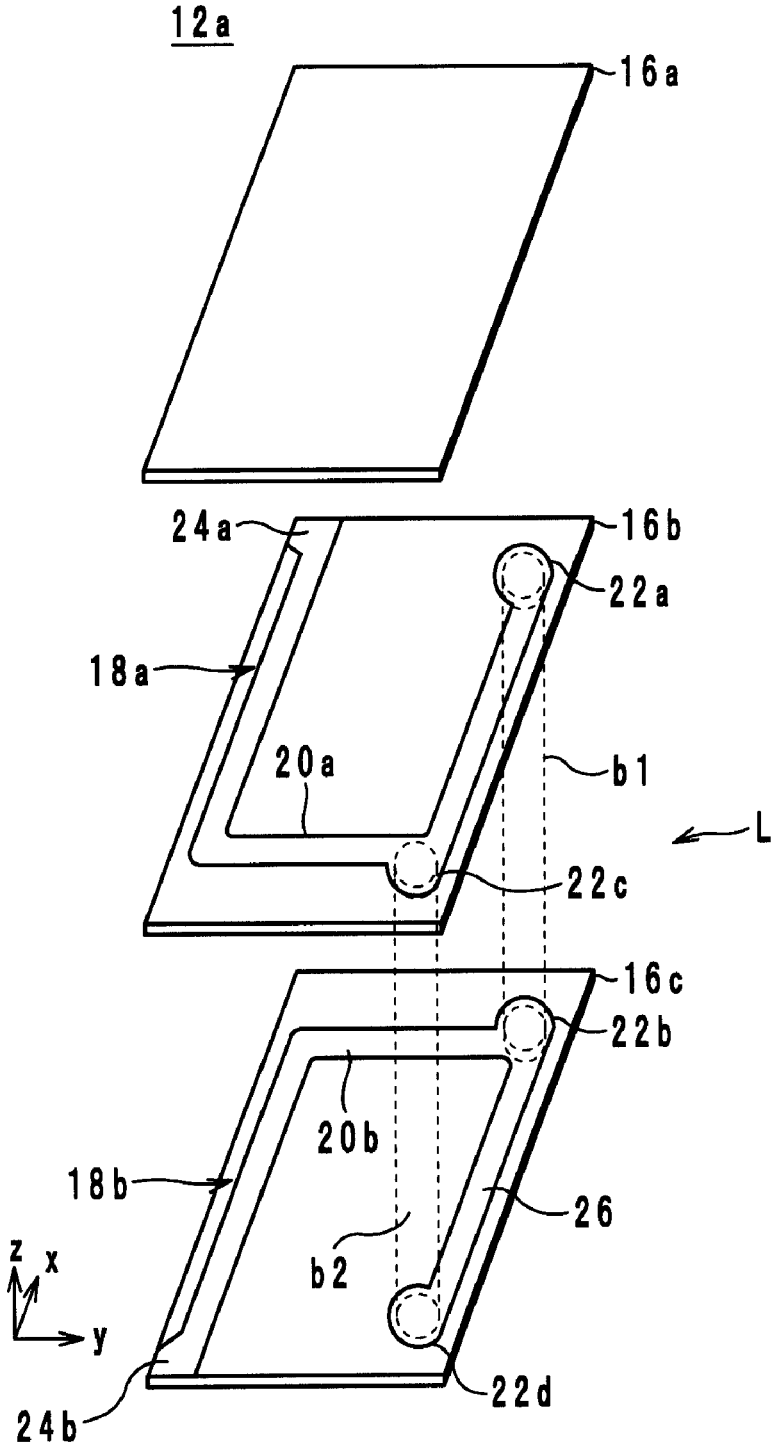
FIG. 6 is an exploded perspective view of a multilayer structure of an exemplary electronic component according to a first modification.

The electronic component 10*a* according to a first exemplary modification is described below with reference to the drawings. FIG. 6 is an exploded perspective view of a multilayer structure 12*a* of the electronic component 10*a* according to the first modification.

The electronic component 10*a* differs from the electronic component 10 in that the electronic component 10*a* includes lands 22*c* and 22*d*, a wiring conductor 26, and a via-hole conductor b2. Specifically, the wiring conductor 26 extends from the land 22*b* toward the negative x-axis direction and overlaps the coil conductor 20*a* in plan view from the z-axis direction. The lands 22*c* and 22*d* are provided at an end in the positive y-axis direction of the short side L2 and overlap each other in plan view from the z-axis direction. In addition, the lands 22*c* and 22*d* do not overlap the lead-out conductor 24*b* in plan view from the z-axis direction. The lands 22*c* and 22*d* protrude toward the negative x-axis direction so as to protrude toward outside the path R. The via-hole conductor b2 connects the lands 22*c* and 22*d*.

For the electronic component 10*a* described above, the wiring conductor 26 is connected substantially in parallel to the coil conductor 20*a* in a section between the via-hole conductors b1 and b2. As a result, the value of direct-current resistance of the coil L of the electronic component 10*a* is smaller than that of the electronic component 10.

Figure 7:
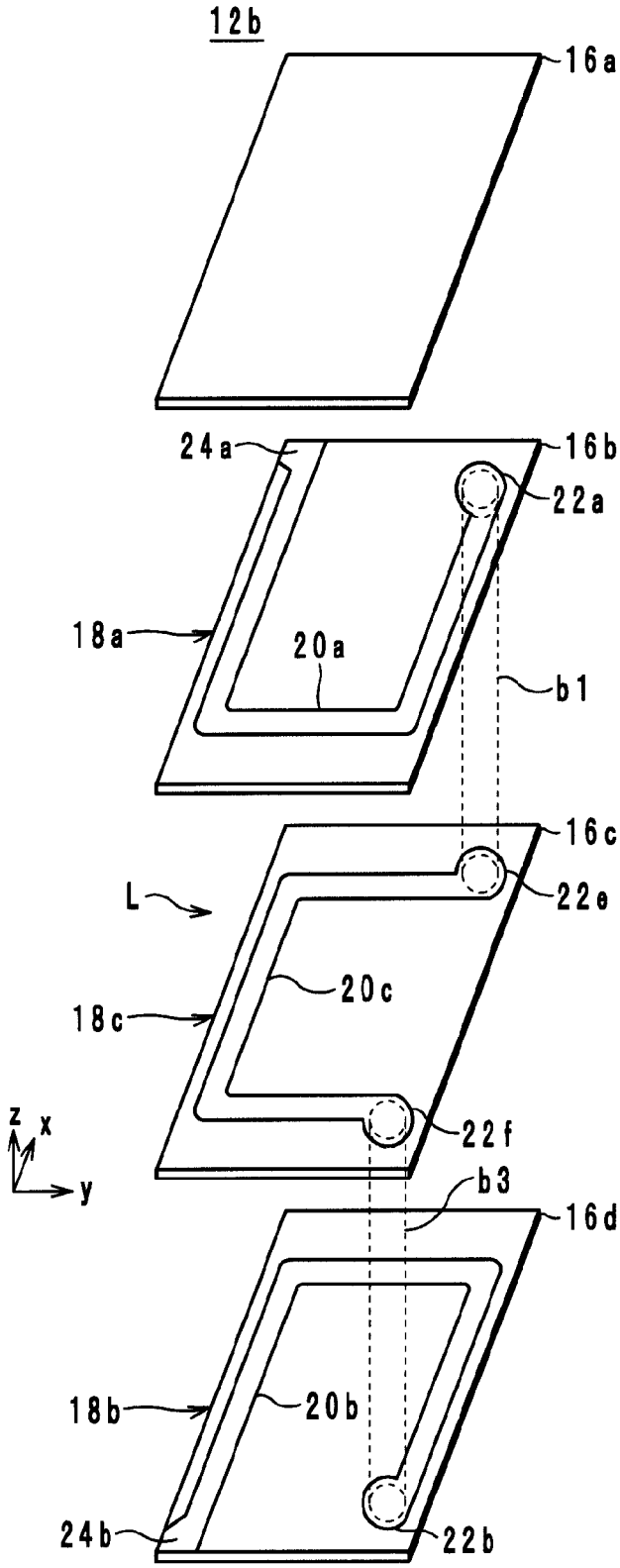
FIG. 7 is an exploded perspective view of a multilayer structure of an exemplary electronic component according to a second modification.
Figure 8:
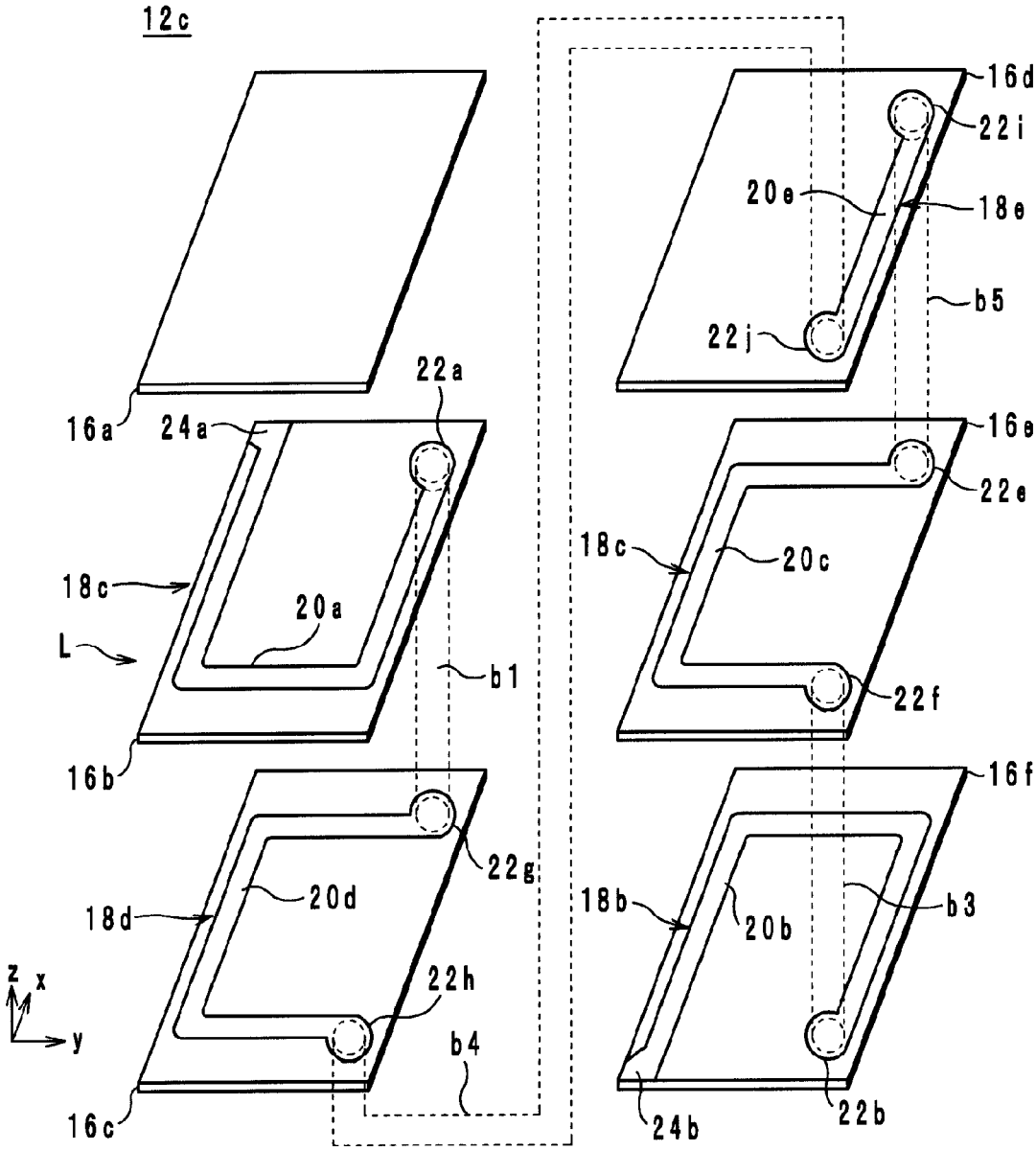
FIG. 8 is an exploded perspective view of a multilayer structure of an exemplary electronic component according to a third modification.

Next, the electronic component 10*b* according to a second exemplary modification and the electronic component 10*c* according to a third exemplary modification are described with reference to the drawings. FIG. 7 is an exploded perspective view of a multilayer structure 12*b* of the electronic component 10*b* according to the second modification. FIG. 8 is an exploded perspective view of a multilayer structure 12*c* of the electronic component 10*c* according to the third modification.

The electronic component 10*b* illustrated in FIG. 7 incorporates the coil L of approximately 2.25 turns. The electronic component 10*c* illustrated in FIG. 8 incorporates the coil L of approximately 3.25 turns. In other words, the number of turns in the electronic component 10 is not limited to approximately 1.25 turns.

Embodiments of the present invention are useful for an electronic component and a method of manufacturing the electronic component and, in particular, are advantageous in that a larger inductance value and a high Q value are obtainable.

While exemplary embodiments of the invention have been described above, it is to be understood that variations and modifications will be apparent to those skilled in the art without departing from the scope and spirit of the invention. The scope of the invention, therefore, is to be determined solely by the following claims.

What is claimed is:

1. An electronic component comprising:

a multilayer structure including a plurality of insulator layers;

a coil including a plurality of coil conductors incorporated in the multilayer structure, a plurality of lands provided at the plurality of coil conductors, and a via-hole conductor connecting the plurality of lands;

first and second external electrodes provided on respective surfaces of the multilayer structure;

a first lead-out conductor incorporated in the multilayer structure and connecting a first end of the coil and the first external electrode; and a second lead-out conductor incorporated in the multilayer structure and connecting a second end of the coil and the second external electrode, wherein the plurality of coil conductors form a substantially rectangular loop path by overlapping each other in plan view from a direction in which a coil axis extends, the first lead-out conductor extends from a first end portion of a first short side of the path and toward outside the path, and the second lead-out conductor extends from a first end portion of a second short side of the path and toward outside the path, and in the plan view, the plurality of lands protrude toward outside the path at at least one of a second end portion of the first short side and a second end potion of the second short side, but no lands of the coil overlap the first end portion of the first short side and the first end portion of the second short side.

2. The electronic component according to claim 1, wherein each of the lands has a width greater than a line width of each of the coil conductors.

3. The electronic component according to claim 2, wherein the via-hole conductor has a diameter larger than the line width of each of the coil conductors.

4. A method of manufacturing the electronic component according to claim 1, the method comprising:

forming, by a photolithography process, the insulator layers each having a via hole provided at a location where the via-hole conductor is to be provided; and forming the coil conductors, the lands, and the via-hole conductor on the insulator layers.

5. A method of manufacturing the electronic component according to claim 2, the method comprising:

forming, by a photolithography process, the insulator layers each having a via hole provided at a location where the via-hole conductor is to be provided; and forming the coil conductors, the lands, and the via-hole conductor on the insulator layers.

6. A method of manufacturing the electronic component according to claim 3, the method comprising:

forming, by a photolithography process, the insulator layers each having a via hole provided at a location where the via-hole conductor is to be provided; and forming the coil conductors, the lands, and the via-hole conductor on the insulator layers.

* * * * *